US010669740B2

(12) United States Patent
Szerszen

(10) Patent No.: US 10,669,740 B2
(45) Date of Patent: Jun. 2, 2020

(54) EMERGENCY DOOR LOCK ILLUMINATION APPARATUS

(71) Applicant: Joseph Michael Szerszen, Howell, MI (US)

(72) Inventor: Joseph Michael Szerszen, Howell, MI (US)

( * ) Notice: Subject to any disclaimer, the term of this patent is extended or adjusted under 35 U.S.C. 154(b) by 0 days.

(21) Appl. No.: 16/035,553

(22) Filed: Jul. 13, 2018

(65) Prior Publication Data

US 2020/0018093 A1 Jan. 16, 2020

(51) Int. Cl.

| | |
|---|---|
| ***E05B 17/10*** | (2006.01) |
| ***G08B 7/06*** | (2006.01) |
| ***E05B 65/10*** | (2006.01) |
| ***G09F 13/04*** | (2006.01) |

(52) U.S. Cl.

CPC ..... *E05B 17/10* (2013.01); *E05B 65/1066* (2013.01); *G08B 7/062* (2013.01); *G09F 2013/0459* (2013.01)

(58) Field of Classification Search

CPC ..... G09F 2013/0459; E05B 17/10; E05B 65/1066; G08B 7/062

See application file for complete search history.

(56) References Cited

U.S. PATENT DOCUMENTS

| | | | |
|---|---|---|---|
| 2,778,326 | A | 1/1957 | Guzik |
| 2,824,440 | A | 2/1958 | Jewett et al. |
| 3,345,099 | A | 10/1967 | Paul et al. |
| 3,801,140 | A | 4/1974 | Keller |
| 4,598,939 | A | 7/1986 | Krupicka et al. |
| 4,745,527 | A | 5/1988 | Belverio, Jr. et al. |
| 4,763,937 | A | 8/1988 | Sittnick, Jr. et al. |
| 4,839,988 | A | 6/1989 | Betts et al. |

(Continued)

FOREIGN PATENT DOCUMENTS

| | | |
|---|---|---|
| CN | 202647489 | 1/2013 |

OTHER PUBLICATIONS

Design Patent Panic Door Lock, Double Latch Project—http://hkregal.en.alibaba.com/product 6 pages, date unknown.

(Continued)

*Primary Examiner* — Anh T Mai
*Assistant Examiner* — Zachary J Snyder
(74) *Attorney, Agent, or Firm* — J. Gordon Lewis

(57) ABSTRACT

An emergency illumination apparatus is integrated into a door lock mechanism including a manual release member and a latch which is displaceable between an engaged position with the jamb of an associated exit door, and a disengaged position, enabling opening of the door. The apparatus includes an illumination device including a base member mounted to the door lock mechanism or a surface of the associated exit door and a spaced array of discrete illumination elements extending along at least one axis intersecting with or circumventing the manual release member. A sensor operates to detect an emergency condition such as the presence of excessive heat, smoke, carbon monoxide, noxious gas and the like, and generate an alarm signal in response thereto. An independent power supply is disposed within the emergency door lock illumination apparatus. A controller energized by the power supply activates the illumination device in response to the alarm signal.

19 Claims, 6 Drawing Sheets

(56) References Cited

U.S. PATENT DOCUMENTS

| | | | | |
|---|---|---|---|---|
| 4,961,330 | A | 10/1990 | Evans | |
| 5,018,290 | A | 5/1991 | Kozek et al. | |
| 5,088,786 | A | 2/1992 | Linder | |
| 5,499,171 | A | 3/1996 | Simpson et al. | |
| 5,597,227 | A | 1/1997 | Bergen et al. | |
| 5,724,909 | A * | 3/1998 | Pitman | F21K 2/00 116/202 |
| 5,904,017 | A * | 5/1999 | Glatz | E04F 19/04 250/462.1 |
| 5,947,534 | A | 9/1999 | Zarzycki, Jr. | |
| 6,553,815 | B1 | 4/2003 | Rasringer | |
| 6,715,225 | B1 * | 4/2004 | Frolov | E05B 65/1053 292/336.3 |
| 8,021,012 | B2 | 9/2011 | Dunbar | |
| 8,083,367 | B2 | 12/2011 | Anderson et al. | |
| 8,362,898 | B2 | 1/2013 | Bersdtis et al. | |
| 9,163,428 | B1 * | 10/2015 | Fare | E05B 17/10 |
| 9,265,115 | B1 * | 2/2016 | Dunn | F21V 33/006 |
| 2005/0144822 | A1 | 7/2005 | Molokotos et al. | |
| 2007/0222626 | A1 * | 9/2007 | Picard | G08B 7/062 340/584 |
| 2009/0966730 | | 4/2009 | Belaqnger | |
| 2011/0012372 | A1 * | 1/2011 | Presley | G09F 13/20 292/92 |
| 2016/0027266 | A1 | 1/2016 | McDonagh et al. | |
| 2017/0175994 | A1 * | 6/2017 | Kowash | F21V 33/006 |
| 2019/0374864 | A1 * | 12/2019 | Cragle | E05F 5/00 |

OTHER PUBLICATIONS

Double Door Knob Lock Parts Names—Google, 3 pages, date unknown.

* cited by examiner

EMERGENCY DOOR LOCK ILLUMINATION APPARATUS

TECHNICAL FIELD

The present invention is related to emergency exit door illumination systems.

BACKGROUND OF THE INVENTION

Illuminated fire exit signs employed in public buildings and offices around the world are used to identify the fire evacuation exit routes and a final exit. These signs conform to various international codes such as ISO7010/ISO3864-1 and UL924. Most of these signs are either consistently illuminated or illuminate upon power failure. They show pictogram type symbols such as a running man, a door and an arrow or the word EXIT and chevrons depicting the route to take during an emergency. Most of these signs are required under these codes to exhibit a specific amount of illumination and to provide an emergency back-up power source for a specified period of time should the power fail. In the main, these types of signs are adequate when they are seen by people during an evacuation. However, recent academic studies have suggested and proven that current fire exit signs covered by these international standards are less effective as an aid to emergency egress than they potentially can be.

A search of issued U.S. patents in the field of emergency exit illumination systems and related apparatus reveals U.S. patents related generally to the field of the present invention but which do not anticipate nor disclose the device of the present invention. The discovered U.S. patents relating generally to the present invention are discussed herein below.

U.S. Patent Application Publication No. 2016/0027266 A1 to Mc Donagh et al. entitled "Emergency Exit Sign" discloses a dynamic emergency exit sign comprising one or more pictograms and at least one light source for accentuating one or more of the one or more pictograms either singly or in combination, wherein at least one light source is controlled by signals from evacuation computer modeling software to assist occupants egress in emergency or other critical situations. Specifically, the exit sign comprises a microprocessor for changing which of the one or more light sources is lit according to information received from evacuation computer modelling software.

U.S. Pat. No. 5,018,290 to Kozek et al. entitled "Exit Sign" discloses an exit sign including a plurality of rugged low voltage incandescent lamps mounted on a printed circuit board (PCB) to provide proper illumination. The lamps are positioned to provide indirect illumination to the "EXIT" stenciling of the exit sign. The exit sign can be adapted for use with low voltage alternating current and low voltage emergency direct current. Because the lamps are driven at low voltage and are resistant to failure due to vibration, etc., they can be expected to attain a long life in service.

U.S. Pat. No. 8,083,367 B2 to Anderson et al. entitled "Emergency Exit Route Illumination System and Methods" discloses a system and method that helps evacuees exit a building in the event of an emergency such as a smoke event, a fire, an earthquake, a security breach, and/or the presence of unsafe levels of hazardous gasses, using linear illuminators parallel to and near the floor of an interior room or hallway to provide floor-level identification and illumination of the exit route to be used in the event of such an emergency, with some linear illuminators having directional aspects along hallways to lead evacuees toward an exit, and other illuminators outlining the perimeter of windows or doors that are safe to exit through, the illuminators normally being hardly noticeable but having controllers and energizers linked to the alarm and security systems of hospitals, hotels, residences and other occupied building structures to light up the planned exit route when emergency conditions are detected.

U.S. Pat. No. 5,499,171 to Simpson et al. entitled "Door Lock Illumination Apparatus" discloses a door lock illumination apparatus for illuminating a door lock assembly carried by a dwelling door which is adjacent to a dwelling door frame and which is in close proximity to a storm door and to an AC (alternating current) power source. The door lock illumination apparatus includes a storm-door-responsive switch assembly mounted on a portion of the dwelling door frame. An AC powered illumination source is mounted on a portion of the dwelling door frame in proximity to the door lock assembly. A first conductor assembly is connected between the AC-powered illumination source and a storm-door-responsive switch assembly. A second conductor assembly is connected between the storm-door-responsive switch assembly and the AC power source, and a third conductor assembly is connected between the AC-powered illumination source and the AC power source. The storm-door-responsive switch assembly includes a normally closed switch. A storm-door-contacting switch actuator contacts the storm door when the storm door is closed. The normally closed switch remains open when the storm door is in contact with the storm-door-contacting switch actuator, and the normally closed switch closes when the storm door is removed from contact with the storm-door-contacting switch actuator.

U.S. Pat. No. 4,839,988 to Betts et al. entitled "Panic Exit Device", U.S. Pat. No. 4,961,330 to Evans entitled "High Security Panic Exit System", and U.S. Pat. No. 5,088,786 to Linder entitled "Panic Exit Door Mechanism" each disclose a panic exit device for doors having in their active side vertically operating bolts extending from the top and bottom of the door and a mechanism for retracting the bolts. Usually, the retracting mechanism may be activated by using a key in the exterior door lock or by depressing a panic baron the interior of the door. The panic exit device includes a device for actuating the bolt retention mechanism which is mounted inside a semi-hollow enclosure which is integral with the door. The mounting is accomplished with screws hidden from view by a member securing the moldings. The panic exit device also provides a dogging mechanism to lock the actuator device in the actuated position, while simultaneously preventing excessive play in the panic bar.

U.S. Published Patent Application 2005/0144822 A1 to Molokotos et al. entitled "Exit Device with Lighted Touchpad" includes an electroluminescent exit sigh assembly, preferably mounted on a push rail actuator of the exit device. An electroluminescent illuminator, an opaque material and a transparent protective cover form the electroluminescent sign assembly. The push rail actuator operates a mechanism and opens an associated exit door when pressure is applied. An inverter may be located within the exit device to power the electroluminescent illuminator with an AC or voltage. The electroluminescent sign assembly is preferably removable for repair or replacement without removing the exit device from the exit door and is located within a surface cavity in an electrically insulating touchpad on the exit device actuator. Additional transparent nonconductive material surrounds the electroluminescent material to provide further electrical insulation.

None of the above listed U.S. patents disclose or suggest an emergency door lock illumination apparatus of the present invention. Each of the above listed U.S. patents and published applications (i.e., U.S. 2016/0027266 A1; U.S. Pat. Nos. 5,018,290; 8,083,367 B2; 5,499,171; 4,839,988; U.S. Pat. Nos. 4,961,330; 5,088,786; and U.S. 2005/0144822 A1) are hereby incorporated herein by reference.

SUMMARY OF THE INVENTION

The forgoing problems and limitations are overcome and other advantages are provided by a new and improved emergency door lock illumination system which provides stand-alone operability, manager access, operational interface with other related building systems and notification access to emergency services.

Therefore, it is an object of the present invention to provide a novel reconfigurable emergency door lock illumination system.

The present invention provides an emergency door lock illumination apparatus including a door lock mechanism having a manual release member and a latch, wherein the manual release member is user operable to displace the latch from an engaged position with a jamb of an associated exit door and a disengaged position with respect to the jamb enabling opening of the exit door. An illumination device is provided including a base member adapted for mounting to the door lock mechanism or a surface of the associated exit door, wherein the illumination device further includes a spaced array of discrete illumination elements extending along at least one axis intersecting with or circumventing the manual release member. A sensor operates to detect an emergency condition such as the presence of excessive heat, smoke, carbon monoxide, noxious gas and the like, and to generate an alarm signal in response thereto. An independent power supply is disposed within the emergency door lock illumination apparatus. Lastly, a controller energized by said power supply is operative to activate said illumination device in response to said alarm signal.

According to one aspect of the invention, the controller is operative to sequentially actuate the illumination elements in a predetermined order, commencing with the illumination element distal from said latch and progressing to the illumination element proximate said latch in response to detecting an emergency condition. This arrangement tends to draw an observer's attention to the precise location of the manual release member to ensure rapid and precise operation of an associated emergency door lock, even under limited visibility conditions.

According to another aspect of the invention, said controller is operative to vary the intensity of each illumination element as a function of distance from said latch. This arrangement highlights to the observer in a focused manner the precise location of the manual release member.

According to yet another aspect of the invention, said controller is operative to vary the flash rate and/or color of at least one illumination element as a function of said alarm signal. This arrangement further highlights to the observer in a focused manner the precise location of the manual release member.

These and other features and advantages of this invention will become apparent upon reading the following specification, which, along with the drawings, describes preferred and alternative embodiments of the invention in detail.

BRIEF DESCRIPTION OF THE DRAWINGS

The present invention will now be described, by way of example, with reference to the accompanying drawings, in which.

Although the drawings represent embodiments of the present invention, the drawings are not necessarily to scale and certain features may be exaggerated in order to illustrate and explain the present invention. The exemplification set forth herein illustrates an embodiment of the invention, in one form, and such exemplifications are not to be construed as limiting the scope of the invention in any manner.

DESCRIPTION OF THE PREFERRED EMBODIMENTS

Figure 1:
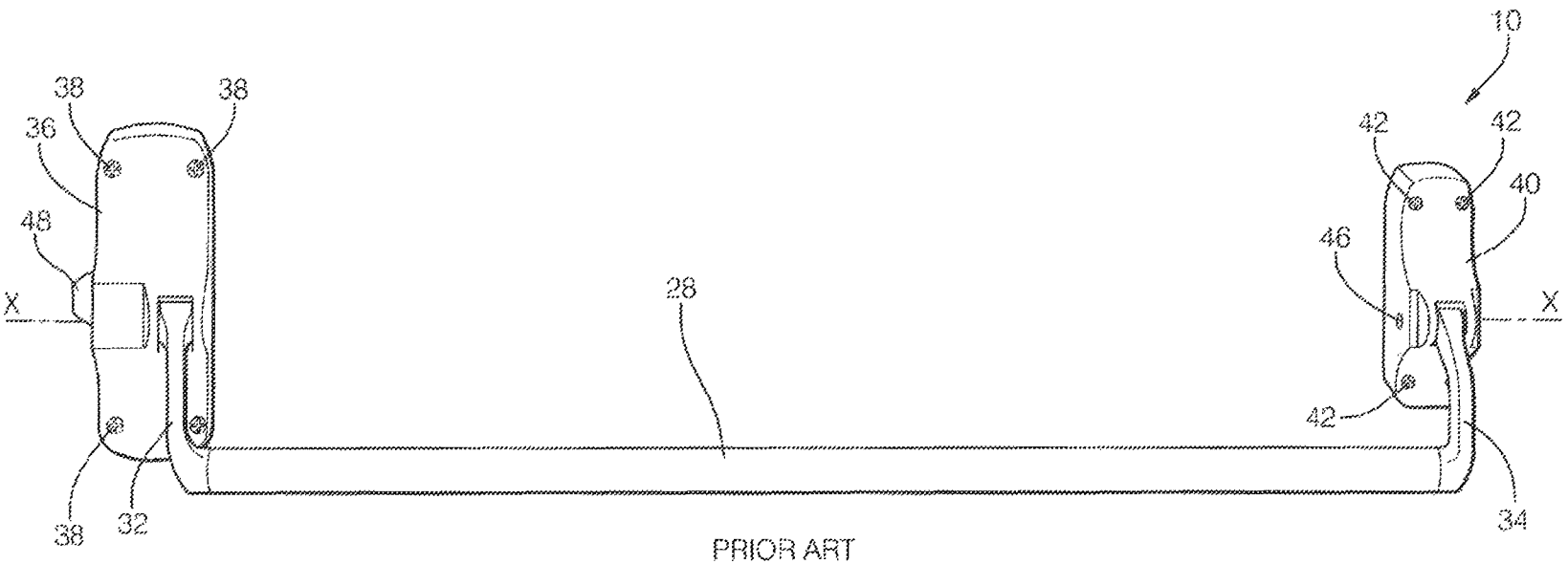
PRIOR ART FIG. 1
FIG. 1, is a frontal plan view of a conventional panic exit door mechanism.
Figure 2:
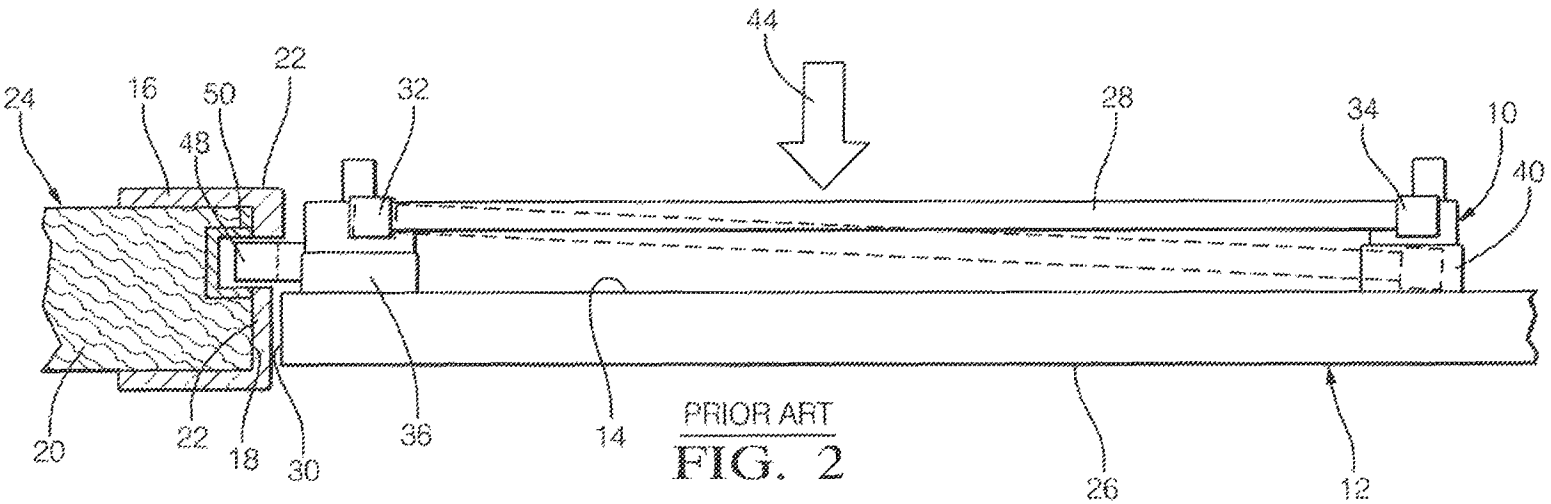
PRIOR ART FIG. 2
FIG. 2, is a top plan view of the panic exit door mechanism of FIG. 1 installed in an exit door in cross-section illustrating ineffective asymmetric manual displacement of the release bar.

Referring to FIGS. 1 and 2, a typical panic door exit mechanism 10 is affixed to an exit door 12 and is primarily intended for application with fire or emergency doors to enable them to be quickly opened outwardly for purposes of escape. The exit mechanism 10 is affixed to an inwardly facing surface 14 of the exit door 12 which is operatively secured within a door frame 16 affixed within an opening 18 formed in an associated building wall 20. The door frame includes at least one side jam 22, a lintel (not illustrated), and a floor surface (not illustrated). It is envisioned that such a panic door exit mechanism 10 would be employed in commercial buildings 24 of the type employed for businesses attracting substantial numbers of customers/employees and subject to appropriate state or local safety codes. As illustrated, the exit door 12 has an outwardly facing surface 26 configured to prevent unauthorized access from the exterior of the building 24. It is contemplated that the exit door 12 could alternatively be an interior door configured to control passage between two discrete sections of a common building.

The panic door exit mechanism 10 includes an elongated release bar or member 28 arranged in horizontally spaced relation substantially midway in height of the door 12 adjacent the free edge 30 and hinged edge (not illustrated) between which the release member 28 extends. Each end of the release member 28 is carried by an actuating arm 32 and 34. Actuating arm 32 is pivotally carried by an actuating unit 36 which is affixed to the inwardly facing surface 14 of the door 12 adjacent the free edge 30 by screws or other suitable fastening hardware 38. Actuating arm 34 is pivotally carried by an outboard unit 40 which is affixed to the inwardly facing surface 14 of the door 12 adjacent the hinged edge (not shown) by screws or other suitable fastening hardware 42. The actuating arm 32 is affixed to the actuating unit 36 by a pivot pin (not illustrated) and the actuating arm 34 is affixed to the outboard unit 40 by a pivot pin 46, thereby enabling limited rotation of the release bar 28, and the actuating arms 32 and 34 as a unified unit about an axis X-X defined by the pivot pins 46. The actuating unit 36 also includes a bolt 48 interconnected with actuating arm 32 by linkage (not illustrated) within the actuating unit 36. The bolt 48 extends within a bolt strike 50 formed in the side jam 22 when the release member 28 is in a released position.

As designed, the panic exit mechanism 10 operates to release the door 12 for outward opening when the release member 28 is pressed in an outward direction by a building occupant anywhere along the horizontal extent thereof as indicated by an arrow 44 which, in turn, momentarily releases the bolt 48 from its associated strike 50 as illustrated in phantom in FIG. 2.

A shortcoming of such panic door exit mechanisms 10 stems from wear or loosening of interconnecting joints between the release bar 28 and the actuating arms 32 and 34 over time, resulting in off-center or rotational displacement of the release member 28 as illustrated in phantom in FIG. 2. Such rotational displacement can result in failure to release the mechanism 10 in an emergency situation wherein the bolt 48 is not fully withdrawn from the strike 50 to a release position illustrated in phantom in FIG. 2.

This condition is exacerbated in emergency conditions wherein vision is impaired such as by the presence of smoke or failure of building illumination. In such conditions, an operator may not be able to effect release of the mechanism 10, even after pushing the release bar 28.

Figure 3:
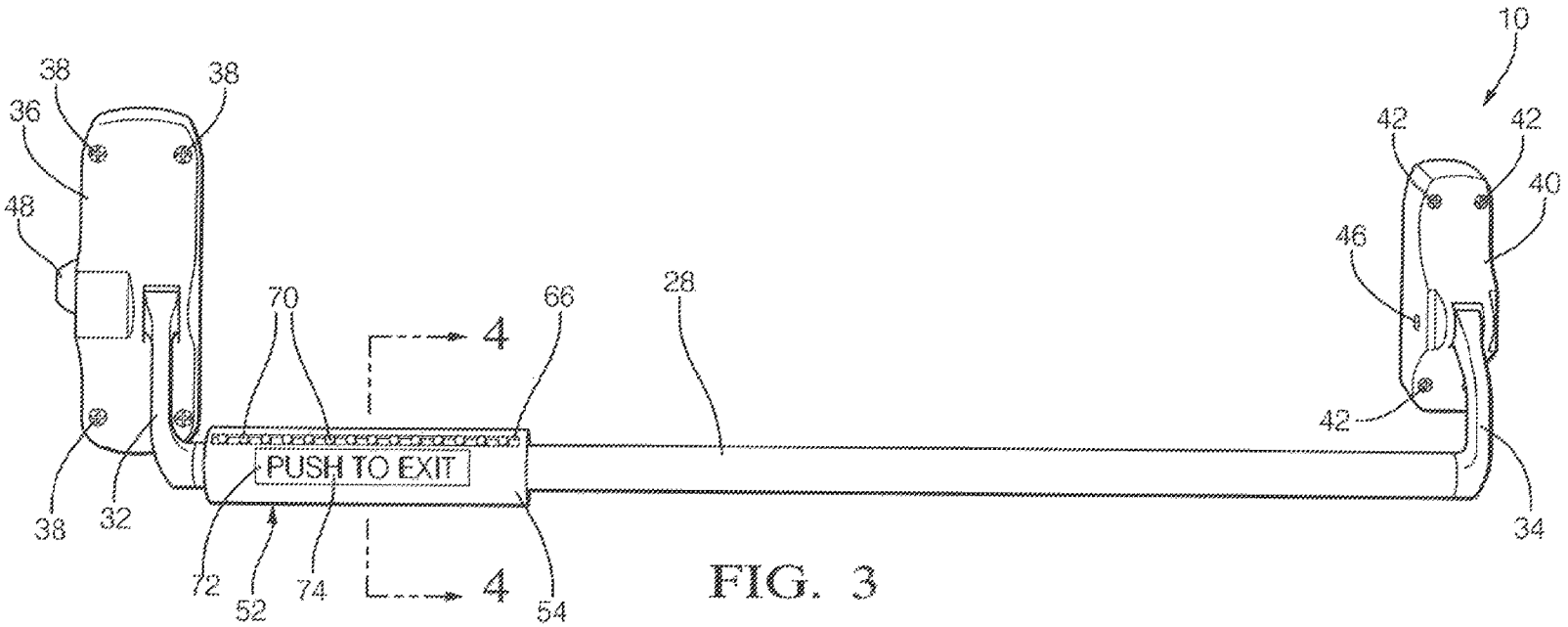
FIG. 3, is a frontal plan view of a first embodiment of a panic exit door mechanism including an illumination system embodying the present invention.
Figure 4:
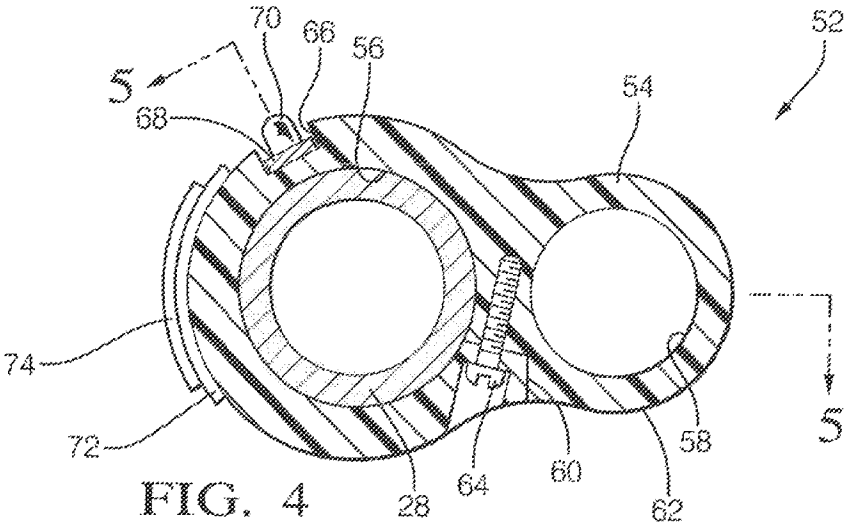
FIG. 4, is a cross-sectional view of the panic door mechanism illumination system of FIG. 3 taken on lines 4-4.
Figure 5:
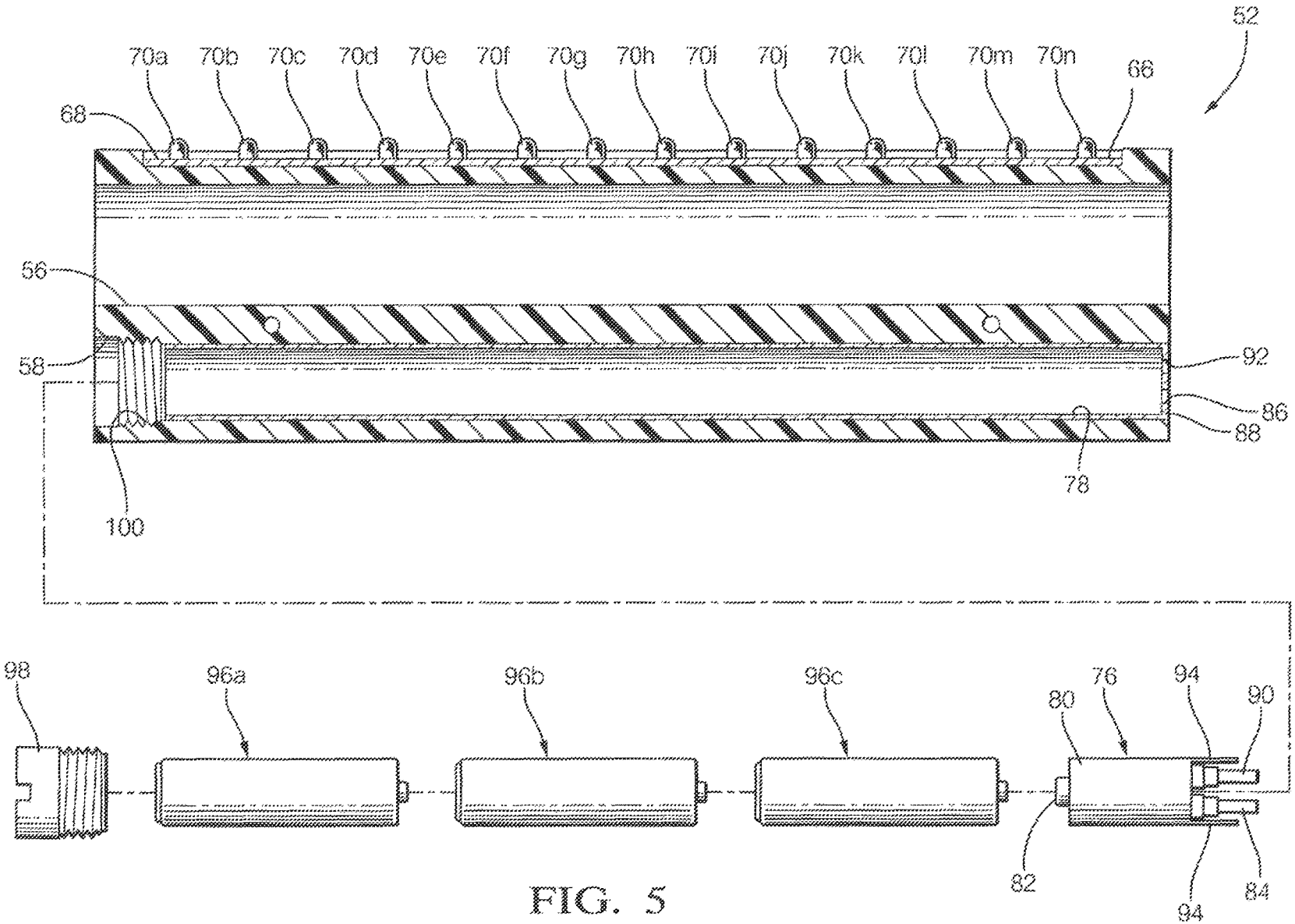
FIG. 5, is an exploded cross-sectional view of the panic door mechanism illumination system of FIG. 4 taken on lines 5-5 illustrating internal details thereof.

Referring to FIGS. 3, 4 and 5, one embodiment of the present invention is illustrated in the form of an emergency door lock illumination apparatus 52 configured for attachment to the end of the release member 28 near the actuating unit 36 of a panic door exit mechanism 10. The emergency door lock illumination apparatus 52 operates as an active visual target, drawing the attention of an individual seeking to affect an emergency exit of an associated building under limited visibility conditions by pushing the portion of the release bar 28 nearest the actuating unit 36. The illumination apparatus 52 includes a base member 54, preferably formed of electrically insulating resilient material such as rubber or vinyl forming a first through passage 56 and a second parallel through passage 58. The base member 54 can be injection molded or extruded and has a continuous cross-section profile. The release bar 28 is illustrated as having a round tubular form. However, it can be oval or irregularly shaped. Further, adhesive or an interlocking key or set screw (not illustrated) is provided to fixedly engage and position the base member 54 to the outer surface of the release bar 28 as illustrated in FIG. 3.

As best illustrated in FIG. 4, an elongated, shaped through cut 60 is formed between the through passage 56 extending to the adjacent outer surface 62 of the base member 54. A screw 64 extends through cut 60 to clampingly engage the base member 54 to the release bar 28. The emergency door lock illumination apparatus 52 is installed by first removing the screw(s) 64, then manually distending the portion of the base member 54 forming the through passage 56 and positioning it about the release bar 28, and finally, replacing the screw(s) 64.

An elongated recess 66 is formed in the outer surface of the base member 54 extending parallel to the release bar 28. A printed circuit board (PCB) or substrate 68 is disposed within the recess 66. A plurality of discrete illumination elements 70 such as light emitting diodes (LEDs), incandescent, or fluorescent lights are affixed to the PCB 68 with associated circuit traces (not illustrated). The plurality of discrete illumination elements 70 form a spaced array and are preferably equally spaced. The leading edge of the base member 54 has a raised surface 72 formed thereon visual and tactile indicia 74 for confirming orientation and functionality in sight impaired situation.

Referring to FIG. 5, interior details of the emergency door lock illumination apparatus 52 are illustrated on an enlarged basis. Fourteen illumination elements designated **70*a*-70*m* are equally spaced along the PCB 68 are interconnected to an electronic controller 76 by an electrical bus (not illustrated) disposed within an electrically conductive liner tube 78 inserted within through passage 58. The electronic controller 76 includes an electrically conductive outer housing 80 slip fit within the liner tube 78, an electrical power contact 82, an antenna 84 extending outwardly through on opening 86 in an end wall 88 of the liner tube 78, and one or more sensors 90 extending outwardly through an opening 92 in the end wall 88. Positioning tabs 94 integrally formed with the housing 80 limit the longitudinal positioning of the controller 76 within the liner tube 78. A plurality of batteries (alkaline, lithium etc.) 96*a*-96*c* are series connected within the liner tube 78. An electrically conductive closure member 98 is in contact with the positive terminal of battery 96*a* and engages threads formed within through passage 58. The closure member 98 is electrically interconnected with the liner tube 78** to complete the power circuit.

The controller 76 includes a radio frequency transceiver, a programmable logic circuit and a memory circuit (not illustrated) rendering the illumination apparatus 52 externally (re) programmable.

The controller 76 is programmed to detect an emergency condition such as the presence of excessive heat, smoke, carbon monoxide, noxious gas, particulates and the like, and to generate an alarm signal activating the illumination device wherein LED **70*m* is first briefly illuminated and then extinguished, followed by LED 70*l* is next briefly illuminated and then extinguished, followed by LED 70*k* is next briefly illuminated and so on until LED 70*a* is illuminated. The duration between the extinguishing of each LED (70*n*-70*a*) and illuminating the next adjacent LED is defined as the dwell time. The longer the dwell time, the more slowly the point of light appears to propagate along the release bar toward the release member or actuating arm 32**.

LEDs **70*a*-70*m* are preferably red in color. LED 70*a* should be of a higher power and remain illuminated for an extended period (exceeding the dwell time) indicating the home or target position. The LED 70*a* can remain illuminated or continue flashing for a period exceeding the dwell time to indicate the final destination. LED 70*n* can be an alternative color such as yellow or green to indicate a low battery charge condition. The controller can be reprogrammed to change the dwell time, or alternatively, to keep all LEDs illuminated until LED 70***a* in illuminated and then repeat the cycle. Furthermore, the controller can be programmed to vary the intensity of illumination of each LED as a function of its distance from the latch.

Figure 6:
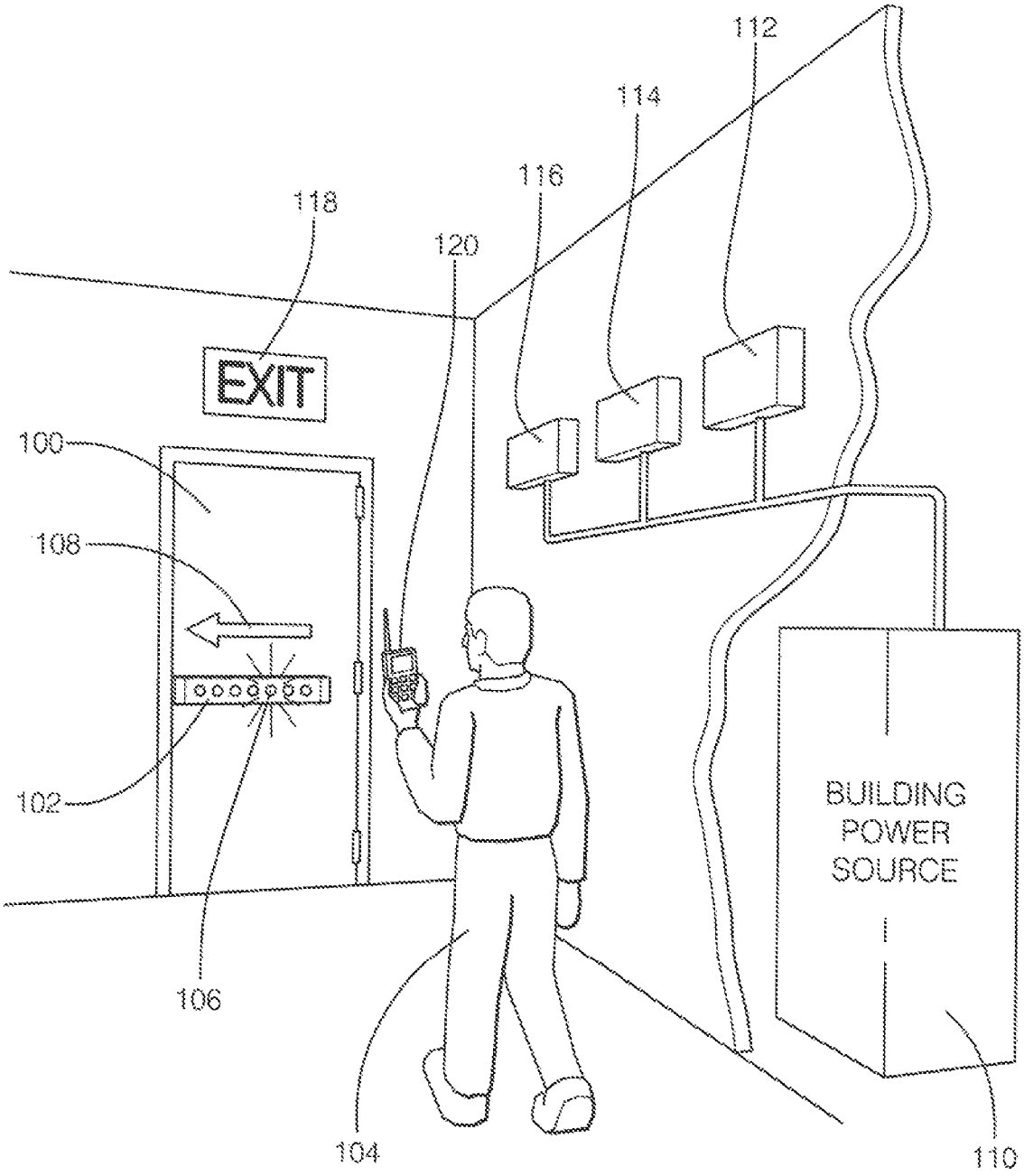
FIG. 6, is a schematic perspective view of the first embodiment of the panic exit door mechanism including an illumination system installed within a commercial building structure.

Referring to FIG. 6, a schematic perspective view of the first embodiment of the panic exit door mechanism including an illumination system installed within a commercial building structure including an exit door 100 equipped with a panic door exit mechanism 102. The eyes of a person 104 seeking to exit the building will naturally follow the apparent right to left displacement of the currently illuminated light 106 as suggested by arrow 108.

In addition to being battery powered system, the illumination system 102 can be powered by the host building power source 110 and be remotely activated by the buildings own fire alarm system 112, carbon monoxide alarm system 114 power failure alarm system and exit warning sign illumination. Furthermore, the person 104 can be pre-equipped with a mobile electronic device 120 with a special application (app) for warning of particularly dangerous or hot spot locations within the building and suggest a preferred exit point, or reprogramming the controller to accommodate changing emergency conditions.

Figure 8:
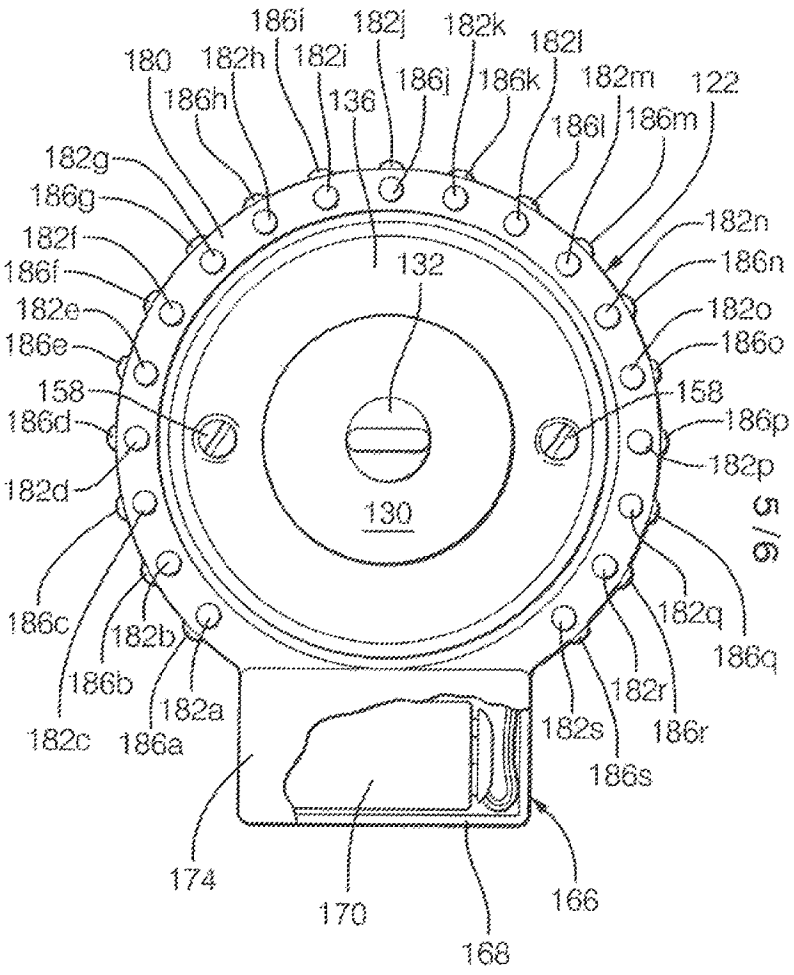
FIG. 8, is a front plan view of the second embodiment the panic exit door mechanism of FIG. 7 including an illumination system carried on the inside surface of the access door.
Figure 7:
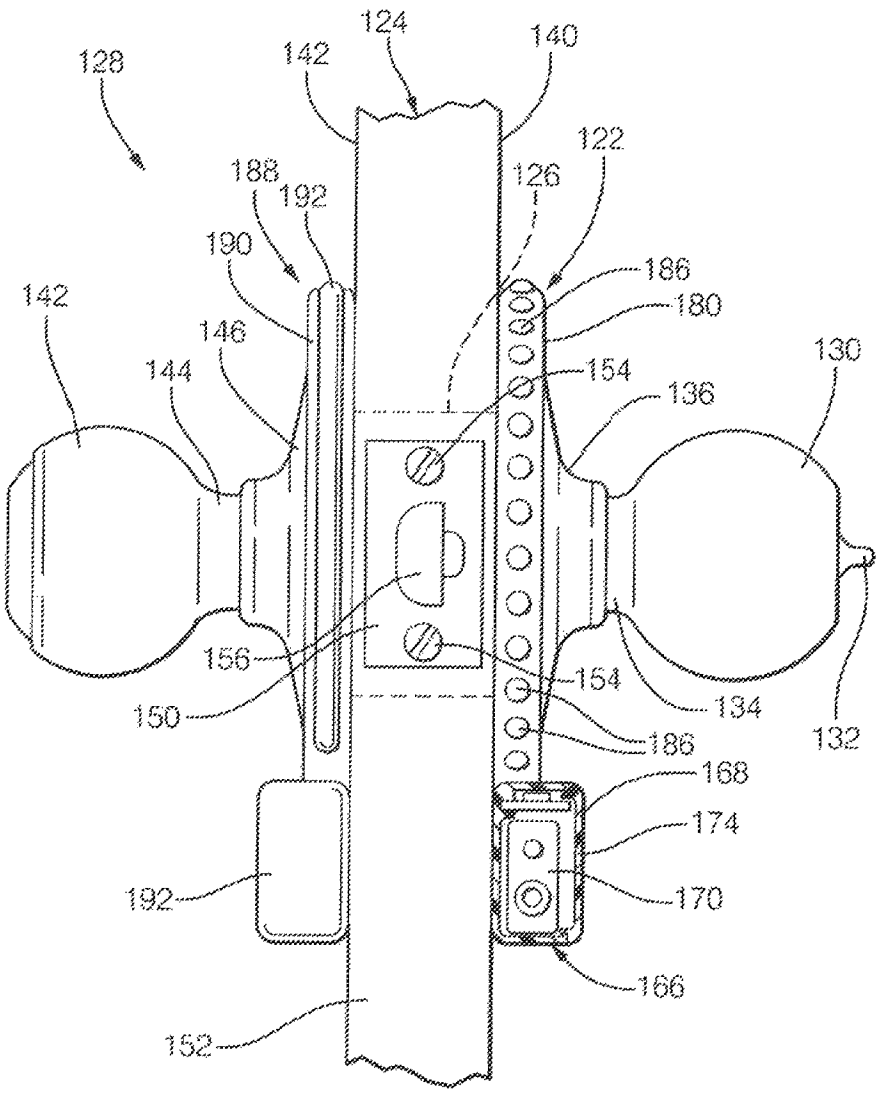
FIG. 7, is a side plan view of a second embodiment a panic exit door mechanism including an illumination system embodying the present invention installed on a residential external or access door.
Figure 9:
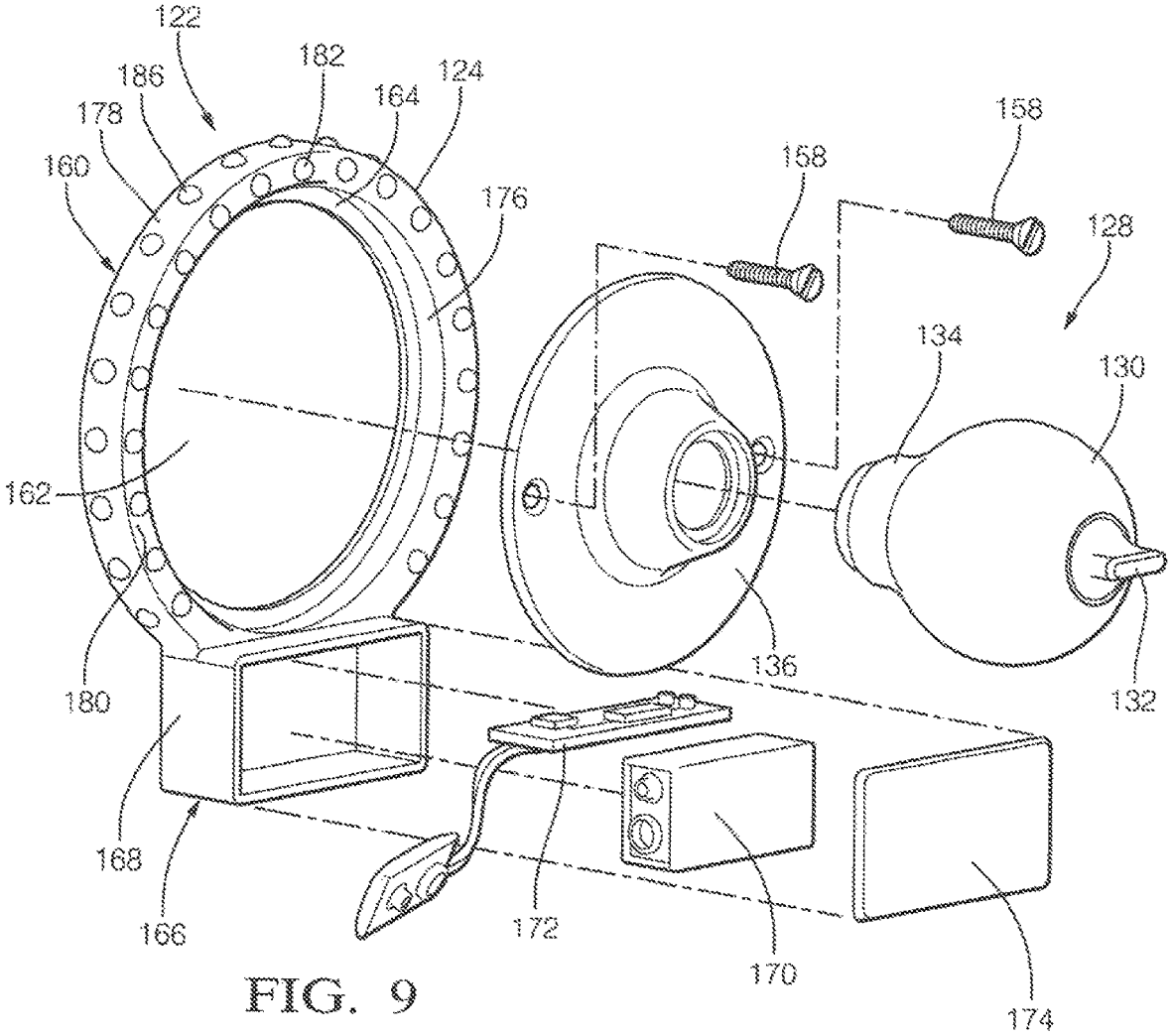
FIG. 9, is an exploded perspective view of the second embodiment the panic exit door mechanism of FIGS. 7 and 8 including an illumination system embodying the present invention.

Referring to FIGS. 7, 8 and 9, a second embodiment of the present invention includes an exit door lock illumination system 122 adapted for application on a "standard" residential external or access door 124 having circular cutouts 126 for receiving a double door knob lock set 128. The double door knob lock set 128 includes an interior knob 130 with a manual rotating lock release tab 132. The interior knob 130 includes a shank 134 extending inwardly through a decorative escutcheon or rose 136 and a mounting plate (not illustrated) secured to the inner surface 140 of the door 124. A cylinder or tumbler (not illustrated) is fitted within the circular cutout 126 of the door 124. An exterior knob 142 includes an externally accessible mortise lockset (not illustrated) and a shank 144 extending inwardly through a decorative escutcheon or rose 146 and a mounting plate (not illustrated) secured to the outer surface 140 of the door 124. A latch assembly 150 is mounted to the free edge 152 of the door 124 by screws 154 and includes a bolt 156 selectively engaging a strike plate (not illustrated) in an adjacent side jam. The bolt is selectively extended/retracted by manipulation of one of the knobs 130/142 via the cylinder/tumbler. The double door knob lock set 128 is retained in clamping engagement with the door 124 by screws 158 which extend through inner escutcheon 132, inner mounting plate cutout 126, latch assembly 150, cylinder, outer mounting plate, outer escutcheon 146 and mortise lockset.

As best viewed in FIGS. 8 and 9, the emergency door lock illumination apparatus 122 includes an annular frame 160 forming a through passage 162 and a radially inwardly directed annular flange 164. A housing assembly 166 is integrally formed with an outer parameter portion of the annular frame 160. The housing assembly 166 includes wall segments 168 dimensioned to nestingly receive miniaturized sensors operative to detect an emergency condition such as the presence of excessive heat, smoke, carbon monoxide, noxious gas, particulates and the like, and to generate an alarm signal in response thereto, a power supply 170 such as a battery, and a controller 172 energized by said power supply and operative to activate said illumination device in response to an alarm signal. The housing assembly 166 can also receive a miniaturized radio frequency transceiver for communication with remote building systems and a remote reprogramming device. A closure member 174 hermetically encloses the interior components within the housing assembly 168. The annular frame 160 of the lock illumination system 122 consists of annular flange 164, an inner peripheral wall 176, an outer peripheral wall 178 and a front facing wall 180 and a rear wall (not illustrated). The inner peripheral wall 176, the outer peripheral wall 178, the front facing wall 180 and the rear wall collectively form a closed annular cavity. A plurality of discrete illumination elements 182 such as light emitting diodes (LEDs), incandescent, or fluorescent lights are affixed to a flexible PCB with associated circuit traces (not illustrated). The nineteen discrete illumination elements 182*a*-182*q* form a circular spaced array, each element extending forwardly through an associated aperture in the front facing wall 180 and are preferably equally circumferentially spaced.

LEDs 182*a*-182*s* are preferably red in color. The LED 70*a* can remain illuminated or continue flashing for a period exceeding the dwell time to indicate the final destination. The controller can be reprogrammed to change the dwell time, or alternatively, to keep all LEDs illuminated until LED 70*a* is illuminated and then repeat the cycle. Furthermore, the controller can be programmed to vary the intensity of illumination of each LED 182. In an emergency situation, a first LED (e.g.: 182*a*) is briefly illuminated and then extinguished. The next adjacent LED (e.g.: 182*b*) is then briefly illuminated and then extinguished. This process is continued until the final LED (e.g.: 182*s*) is briefly illuminated and then extinguished. This process is repeated again and again, creating an illusion of a target circle being formed around the interior knob 130 and its lock release tab 132. The dwell time between illumination of successive LEDs 182 as well as the intensity of the illumination can be varied (i.e. increased and decreased) to enhance the user's focus during a limited vision emergency situation. The successive rotation of light illumination can be clockwise, counter-clockwise, of alternating between the two.

A second set of discrete illumination elements 186*a*-186*s* can be circumferentially distributed about the outer peripheral wall 178 and operate as described hereinabove.

The lock illumination system 122 can be installed with a preexisting double door knob lock set 128 by removing screws 158, the inner knob 130 and escutcheon 136. Next, the lock illumination system 122 is placed against the inner surface 140 of the door 124 concentric with the circular cutout 126. Finally, the knob 130 and escutcheon 136 are replaced in their illustrated position with the outer portion of the escutcheon 136 clamping against the annular flange 164 as the screws 158 are replaced.

As an additional feature, a second outer exit door lock illumination system 188 similar in some regards to the inner exit door lock illumination system 122 can be mounted to the outer surface 142 of the boor 124 by clamping engagement with the outer escutcheon 146. The second outer exit door lock illumination system 188 includes an annular frame 190 and housing assembly 192 containing a redundant power supply (not illustrated). Rather than using discrete illumination elements, the outer exit door lock illumination system 188 has an electroluminescent (EL) wire extending about the periphery of the annular frame 190 which becomes illuminated then ever the inner exit door lock illumination system 122 is activated to draw attention of first responders located outside of the building.

Figure 10:
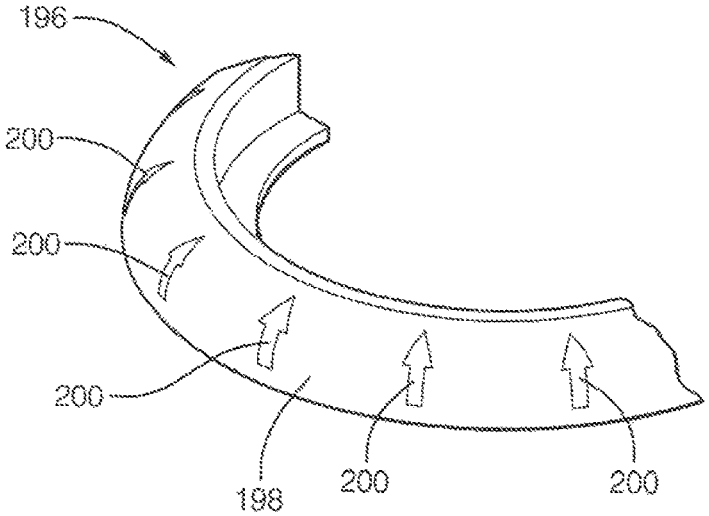
FIG. 10, is a broken perspective of a bezel of a third embodiment the panic exit door mechanism similar to that of FIG. 8 including a plurality of circumferentially arranged luminaries, each shaped as radially inwardly directed arrows.

Referring to FIG. 10, a third embodiment of the present invention, similar in many regards to the embodiment of FIGS. 7, 8 and 9 is illustrated. An annular frame 196, rather than being square or rectangular in cross section as in the case of the embodiment of FIGS. 7, 8 and 9 has a rounded or bezel shaped outer surface. A plurality of arrow shaped luminaires 200 are circumferentially distributed about the annular frame 196. When selectively illuminated, the arrow shaped luminaires 200 act to draw the attention of an observer both circumferentially about the knob 130 and release tab 132, but also radially inwardly toward the knob 130 and release tab 132.

The following documents are deemed to provide a fuller back ground disclosure of the inventions described herein and the manner of making and using same. Accordingly, each the below-listed documents are hereby incorporated into the specification hereof by reference.

U.S. Pat. No. 2,778,326 to Guzik entitled "Panic Latch for Refrigerator Doors and the like".

U.S. Pat. No. 2,824,440 to Jewett et al. entitled "Panic Exit Lock".

U.S. Pat. No. 3,345,099 to Paul et al. entitled "Panic Exit Device".

U.S. Pat. No. 3,801,140 to Keller entitled "Pre-Insulated Pipe Conduit with Test Passage".

U.S. Pat. No. 4,598,939 to Krupicka et al. entitled "Exit Device".

U.S. Pat. No. 4,745,527 to Belverio et al. entitled "Illuminated Door Lock Scratch Guard".

U.S. Pat. No. 4,763,937 to Sittnick Jr. et al. entitled "Electromagnetic Door Lock System".

U.S. Pat. No. 4,839,988 to Betts et al. entitled "Panic Exit Device".

U.S. Pat. No. 4,961,330 to Evans entitled "High Security Panic Exit System".

U.S. Pat. No. 5,018,290 to Kozek et al. entitled "Exit Sign".

U.S. Pat. No. 5,088,786 to Linder entitled "Panic Exit Door Mechanism".

U.S. Pat. No. 5,499,171 to Simpson et al. entitled "Door Lock Illumination Apparatus".

U.S. Pat. No. 5,597,227 to Bergen et al. entitled "Illuminated Door Lock".

U.S. Pat. No. 5,790,034 to Khoury entitled "Retrofittable Remote Controlled Door Lock System".

U.S. Pat. No. 5,947,534 to Zarzycki Jr. entitled "Panic Exit Device Suitable for use with Standard Doors".

U.S. Pat. No. 6,553,815 B1 to Rastinger entitled "Method and Apparatus for Permitting Stable Operation of a Vehicle at Extremely Low Vehicle Speed".

U.S. Patent Application Publication No. 2005/0144822 A1 to Molokotos et al. entitled "Exit Device with Lighted Touchpad".

U.S. Patent Application Publication No. 2009/0096630 A1 to Belanger entitled "Laser Lighted Guidance Exit Indicator".

U.S. Pat. No. 8,021,012 B2 to Dunbar entitled "Assembly for Doorway Illumination".

U.S. Pat. No. 8,083,367 B2 to Anderson et al. entitled "Emergency Exit Route Illumination System and Methods".

U.S. Pat. No. 8,362,898 B2 to Berstis et al. entitled "Key Fob and System for Indicating the Lock Status of a Door Lock".

U.S. Pat. No. 9,163,428 B1 to Fare entitled "Door Lock Illumination Apparatus".

U.S. Patent Application Publication No. 2016/0027266 A1 to Mc Donagh et al. entitled "Emergency Exit Sign".

It is to be understood that the invention has been described with reference to specific embodiments and variations to provide the features and advantages previously described and that the embodiments are susceptible of modification as will be apparent to those skilled in the art.

Furthermore, it is contemplated that many alternative, common inexpensive materials can be employed to construct the basis constituent components. Accordingly, the forgoing is not to be construed in a limiting sense.

The invention has been described in an illustrative manner, and it is to be understood that the terminology, which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for illustrative purposes and convenience and are not in any way limiting, the invention, which is defined by the following claims as interpreted according to the principles of patent law, including the Doctrine of Equivalents, may be practiced otherwise than is specifically described.

The invention claimed is:

1. A self-contained emergency door lock illumination apparatus adapted for retrofitting to an associated exit door lock mechanism of the type including an elongated tubular manual release member pivotally mounted to an exit door and a bolt, said manual release member operable to displace said bolt from an engaged position with a jamb of said associated exit door and a disengaged position with respect to said jamb enabling opening of said exit door, said emergency door lock illumination apparatus comprising;

a base member adapted for selective mounting to a portion of said manual release member closest to said bolt for displacement therewith;

a linear array of spaced apart discrete illumination elements, such as LEDs, extending along a line substantially parallel to an axis of elongation of said manual release member;

a sensor disposed within said base member operative to detect an emergency condition such as the presence of excessive heat, smoke, carbon monoxide, noxious gas, particulates and the like, and to generate an alarm signal in response thereto;

an independent power supply disposed within said base member; and a controller disposed within said base member energized by said power supply and operative to activate said illumination device in response to said alarm signal to illuminate sequentially from a first illumination element furthest from said bolt, to subsequent intermediate illumination elements to a final illumination element closest to said bolt.

2. The emergency door lock illumination apparatus of claim 1, wherein said controller is operative to sequentially activate said illumination elements commencing with the illumination element distal from said bolt and progressing to the illumination element proximate said latch in response to detecting an emergency condition.

3. The emergency door lock illumination apparatus of claim 1, wherein said controller is operative to vary the intensity of each illumination element as a function of distance from said bolt.

4. The emergency door lock illumination apparatus of claim 1, wherein said controller, said power supply and said sensor means are integrally disposed within said base member.

5. The emergency door lock illumination apparatus of claim 1, wherein at least some of said illumination elements are configured as an arrow suggestive of the direction toward a portion of said manual release member nearest said latch.

6. The emergency door lock illumination apparatus of claim 1, wherein at least one of said illumination elements comprise an elongated electroluminescent wire.

7. The emergency door lock illumination apparatus of claim 1, wherein said controller is operative to vary the flash rate of at least one illumination element as a function of said alarm signal.

8. The emergency door lock illumination, apparatus of claim 1, wherein said controller is operative to vary the color of at least one illumination element as a function of said alarm signal.

9. The emergency door lock illumination apparatus of claim 1, wherein said sensor means is operative to detect a low voltage condition and to generate an alarm signal in response thereto.

10. The emergency door lock illumination apparatus of claim 1, wherein said illumination device further includes a tactile indicator integrally formed on an exposed outer surface of said base member.

11. The emergency door lock illumination apparatus of claim 1, wherein said controller comprises a radio frequency transceiver operable to receive remote control signals from a remote personal communication device.

12. The emergency door lock illumination apparatus of claim 11, wherein said remote control signals are operative to effect actuation of said emergency door lock illumination apparatus.

13. The emergency door lock illumination apparatus of claim 11, wherein said remote control signals are operative to effect resetting of predetermined operational features of said controller.

14. The emergency door lock illumination apparatus of claim 1, wherein at least one of said illumination elements has a color or illumination intensity differing from other of said illumination elements as an indication of a power supply fault condition.

15. The emergency door lock illumination apparatus of claim 1, wherein said base member is formed of resilient electrically insulating material.

16. The emergency door lock illumination apparatus of claim 1, wherein said array of discrete illumination elements are insert molded within said base member.

17. The emergency door lock illumination apparatus of claim 1, wherein the discrete illumination element closest to said bolt is illuminated with an operational dwell time exceeding operational dwell times of the remaining illumination elements.

18. The emergency door lock illumination apparatus of claim 1, wherein said controller comprises a radio frequency transceiver operable to transmit preprogrammed emergency notification signals to emergency response services such as 911, fire, police and the like.

19. A self-contained emergency door lock illumination apparatus adapted for retrofitting to an existing door lock mechanism type including an elongated tubular manual release member pivotally mounted on an exit door and a bolt, said manual release member operable to displace said bolt from an engaged position with a jamb of said associate exit door and a disengaged position with respect to said jamb enabling opening of said exit door, said emergency door lock illumination apparatus comprising;

a base member formed of resilient, electrically insulating material adapted for selective mounting to said manual release member for displacement therewith, said base member forming a first through passage receiving a portion of said manual release member closest to said bolt, and a second through passage;

a spaced apart linear array of discrete illumination elements carried on an outer surface of said base member and extending along a line substantially parallel to an axis of elongation of said manual release member;

a sensor operative to detect an emergency condition such as the presence of excessive heat, smoke, carbon monoxide, noxious gas, particulates and the like, and to generate an alarm signal in response thereto, said sensor disposed within a said second through passage of said base member;

an independent power supply disposed within the second through passage of said base member; and a controller energized by said power supply disposed within the second through passage of said base member and operative to activate said illumination device in response to said alarm signal, whereby the controller sequentially activates said illumination elements commencing with the illumination element most distal from said bolt and progressing one at a time to the illumination element proximate said bolt in response to detecting an emergency condition to form an active visual target tending to draw a user's focus toward the bolt, wherein said array of discrete illumination elements are insert molded within said base member, and wherein said illumination device further includes a tactile indicator integrally formed on an exposed outer surface of said base member.

* * * * *